US010013963B1

(12) United States Patent
Ka et al.

(10) Patent No.: US 10,013,963 B1
(45) Date of Patent: Jul. 3, 2018

(54) METHOD FOR PROVIDING A MELODY RECORDING BASED ON USER HUMMING MELODY AND APPARATUS FOR THE SAME

(71) Applicant: COOLJAMM Company, Seoul (KR)

(72) Inventors: Keehwan Ka, Yongin-si (KR); Jiho Ahn, Seoul (KR); Yeonju Kang, Seoul (KR); Ji Eun Park, Seoul (KR)

(73) Assignee: COOLJAMM Company, Seoul (KR)

( * ) Notice: Subject to any disclaimer, the term of this patent is extended or adjusted under 35 U.S.C. 154(b) by 0 days.

(21) Appl. No.: 15/812,335

(22) Filed: Nov. 14, 2017

(30) Foreign Application Priority Data

Sep. 7, 2017 (KR) ..... 10-2017-0114280

(51) Int. Cl.

| | |
|---|---|
| ***A63H 5/00*** | (2006.01) |
| ***G04B 13/00*** | (2006.01) |
| ***G10H 1/00*** | (2006.01) |
| ***G10H 1/32*** | (2006.01) |

(52) U.S. Cl.
CPC ..... *G10H 1/0008* (2013.01); *G10H 1/0033* (2013.01); *G10H 1/32* (2013.01); *G10H 2210/061* (2013.01); *G10H 2210/066* (2013.01); *G10H 2210/076* (2013.01); *G10H 2210/086* (2013.01); *G10H 2220/096* (2013.01)

(58) Field of Classification Search
CPC ..... G10H 1/0008; G10H 1/0033; G10H 1/32; G10H 2210/061; G10H 2210/066; G10H 2210/076; G10H 2210/086; G10H 2220/096; G10H 2230/015; G10H 1/0025
USPC ..... 84/609
See application file for complete search history.

(56) References Cited

U.S. PATENT DOCUMENTS

| | | | | |
|---|---|---|---|---|
| 4,771,671 | A * | 9/1988 | Hoff, Jr. | G10H 1/366 84/453 |
| 6,528,715 | B1 * | 3/2003 | Gargi | G10H 1/0033 84/615 |
| 9,824,719 | B2 * | 11/2017 | Gehring | G11B 20/10527 |
| 9,852,721 | B2 * | 12/2017 | Kozielski | G10H 1/0008 |
| 2005/0086052 | A1 * | 4/2005 | Shih | G06F 17/30743 704/207 |
| 2008/0190272 | A1 * | 8/2008 | Taub | G10H 1/0058 84/645 |
| 2009/0164902 | A1 * | 6/2009 | Cohen | G10H 1/0025 715/716 |
| 2009/0217805 | A1 * | 9/2009 | Lee | G10H 1/0025 84/611 |
| 2010/0192752 | A1 * | 8/2010 | Bright | G10H 1/366 84/610 |

(Continued)

FOREIGN PATENT DOCUMENTS

KR 20120075185 A 7/2012

*Primary Examiner* — Jeffrey Donels
(74) *Attorney, Agent, or Firm* — Dinsmore & Shohl LLP

(57) ABSTRACT

Provided is a method of providing a melody recording based on a user humming melody in a user device. The method includes displaying a record button to be used to start recording of a humming melody of a user in response to an input of the user, and measuring a pitch of a sound that changes over time based on the humming melody of the user, and displaying a change in the pitch in real time. A region in which the change in the pitch is displayed includes at least a portion of a left region of a screen of the user device.

18 Claims, 17 Drawing Sheets

(56) References Cited

U.S. PATENT DOCUMENTS

| | | | | |
|---|---|---|---|---|
| 2011/0307084 | A1* | 12/2011 | Gehring | G10H 3/125 700/94 |
| 2012/0132056 | A1* | 5/2012 | Wang | G06F 17/30743 84/609 |
| 2012/0223959 | A1* | 9/2012 | Lengeling | G06F 3/04883 345/619 |
| 2014/0053710 | A1* | 2/2014 | Serletic, II | G10H 7/00 84/609 |
| 2014/0140536 | A1* | 5/2014 | Serletic, II | G06F 3/0481 381/98 |
| 2017/0092245 | A1* | 3/2017 | Kozielski | G10H 1/0008 |
| 2017/0092246 | A1* | 3/2017 | Manjarrez | G06F 3/04815 |
| 2017/0092320 | A1* | 3/2017 | Gehring | G10H 1/0033 |
| 2017/0140745 | A1* | 5/2017 | Nayak | G10H 1/366 |

* cited by examiner

<1>A(a) + A'(a+b)/A(a) + A'(a+b) + c

<2>C(c+c') + D(d+d')

METHOD FOR PROVIDING A MELODY RECORDING BASED ON USER HUMMING MELODY AND APPARATUS FOR THE SAME

CROSS-REFERENCE TO RELATED APPLICATION(S)

This application claims the priority benefit of Korean Patent Application No. 10-2017-0114280 filed on Sep. 7, 2017, in the Korean Intellectual Property Office, the disclosure of which is incorporated herein by reference for all purposes.

BACKGROUND

1. Field

One or more example embodiments relate to a method of providing a melody recording based on a humming melody of a user and an apparatus for the method, and more particularly, to a method of providing a suitable user interface (UI) in a process of receiving a humming melody through a user device, automatically generating suitable accompaniment and score information based on the input humming melody, and providing a user with the same and an apparatus for the method.

2. Description of Related Art

It may not be easy for non-musicians or amateur musicians to compose music. That is because in general they may not read a score or play a musical instrument such as the piano or the violin, or may lack related expert knowledge. However, an ordinary person who likes music may sing with humming, and often hum a song of his or her favorite singer, a portion of famous classical music, or music that he or she instantly creates. It is not difficult to create and hum his or her own music or melody. However, it may be extremely difficult and take a long time for an amateur musician to compose music based on a humming melody.

Composition of music is difficult because first it is difficult to read a score, second it is difficult to appropriately write musical notes corresponding to sounds that come into mind, and third it is not easy for an amateur musician to have knowledge related to related instruments or play related instruments although he or she needs to do the same to transfer a melody into scores of various instruments. Thus, if there is no need to read a score, directly write musical notes, or discern accurate sounds and rhythms by playing a musical instrument, a desire and a demand of an ordinary person to compose music may be much greater.

Accordingly, a service that may enable an ordinary person not having expert knowledge to easily compose natural music by automatically providing a score and an accompaniment suitable for a humming melody simply provided by a user is needed.

SUMMARY

An aspect provides a method and apparatus that may enable an ordinary person not having expert knowledge to easily compose natural music by automatically providing a score and an accompaniment suitable for a humming melody of a user based on the humming melody.

Another aspect also provides a method and apparatus for providing a melody recording based on a humming melody of a user that has a user interface (UI) to increase a user convenience when recording the humming melody of the user.

Still another aspect also provides a method and apparatus for providing a melody recording based on a humming melody of a user that may more naturally connect humming melodies of the user that are recorded discontinuously.

Yet another aspect also provides a method and apparatus for providing a melody recording based on a humming melody of a user that may induce a user to pay by inserting a signature sound into a music source based on a generated accompaniment score.

Further another aspect also provides a method of providing and correcting accompaniment information more intuitively and conveniently by providing an accompaniment pattern for a plurality of musical instruments using a dice dot pattern.

The technical tasks obtainable from the present disclosure are non-limited by the above-mentioned technical tasks. And, other unmentioned technical tasks can be clearly understood from the following description by those having ordinary skill in the technical field to which the present disclosure pertains.

According to an aspect, there is provided a method of providing a melody recording based on a user humming melody in a user device, the method including displaying a record button to be used to start recording of a humming melody of a user in response to an input of the user, and measuring a pitch of a sound that changes over time based on the humming melody of the user, and displaying a change in the pitch in real time. A region in which the change in the pitch is displayed may include at least a portion of a left region of a screen of the user device.

Here, the displaying of the change in the pitch may display a change in the pitch measured within a predetermined period from a current point in time only on a left side of a reference line that is provided in a vertical direction at a center of the screen of the user device. A pitch value at the current point in time may be displayed through a point that moves up and down in real time within the reference line based on a size thereof.

The method may further include displaying a grid region on an upper portion of the screen of the user device to indicate a measure. A grid in the grid region may be displayed to run leftward over time, and the grid region may not overlap the region in which the change in the pitch is displayed.

Information related to a size of a pitch value at the current point in time may be displayed using at least one of a grid indication and a character. The recording may be continued or paused based on whether the user maintains the input with respect to the record button. The method may further include displaying a waveform size of the sound in real time based on the humming melody of the user.

The method may further include displaying a pitch tuning screen before the recording of the humming melody of the user is started. The displaying of the pitch tuning screen may display information related to a size of a pitch value measured based on a current humming input of the user using at least one of a grid indication and a character. The displaying of the pitch tuning screen may display a button to set a noise-related input level. Through an input of the user with respect to the button to set the noise-related input level, a threshold value related to a volume of an input signal set based on a measurement of current external noise may be displayed, and settings related to the volume of the input signal of the user may be changeable based on the threshold value.

The method may further include displaying a score in which a note is generated for each measure within a predetermined time range based on a humming input of the user. The note displayed on the score may be determined based on a predetermined time and a predetermined tempo (beat per minute (BPM)) value. A sound recognized to have a change in the pitch value may be displayed by being converted to a note in a measure of the score after a predetermined period elapses.

The humming melody of the user may be performed through a first recording in a first section and a second recording in a second section which is discontinuous to the first section. The method may further include determining whether a melody at a last portion of the first recording is similar to a melody at a front portion of the second recording. The determining may be performed based on at least one of a vocal range, a chord, a rhythm, and melody pattern information. The method may further include connecting the melody at the last portion of the first recording to the melody at the front portion of the second recording by correcting at least one of the melody at the last portion of the first recording and the melody at the front portion of the second recording in response to determination that the melody at the last portion of the first recording is similar to the melody at the front portion of the second recording. The method may further include adding a bridge including at least one measure between the melody at the last portion of the first recording and the melody at the front portion of the second recording, in response to determination that the melody at the last portion of the first recording is not similar to the melody at the front portion of the second recording.

According to another aspect, there is also provided an apparatus for providing a melody recording based on a user humming melody, the apparatus including a user input receiver configured to receive a humming melody of a user for recording, a pitch measurer configured to measure a pitch from the received humming melody in real time, a record screen processor configured to generate, on a record screen, a record button to be used to start recording of the humming melody in response to an input of the user and a pitch displaying region to display a change in the pitch measured by the pitch measurer in real time, and a display configured to display the record screen. The pitch displaying region may include at least a portion of a left region of the record screen.

The record screen may display a change in the pitch measured within a predetermined period from a current point in time only on a left side of a reference line that is provided in a vertical direction at a center of the record screen. A pitch value at the current point in time may be displayed through a point that moves up and down in real time within the reference line based on a size thereof.

The record screen processor may further be configured to generate a grid region on an upper portion of the record screen to indicate a measure. A grid in the grid region may be displayed to run leftward over time, and the grid region may not overlap the pitch displaying region. The display may be configured to display information related to a size of a pitch value at the current point in time using at least one of a grid indication and a character. The recording may be continued or paused based on whether the user maintains the input with respect to the record button. The display may be configured to display a waveform size of a sound in real time based on the humming melody of the user.

The display may be configured to display a pitch tuning screen before the recording of the humming melody of the user is started. The display may further be configured to display information related to a size of a pitch value measured based on a current humming input of the user using at least one of a grid indication and a character. The display may further be configured to display a button to set a noise-related input level. Through an input of the user with respect to the button to set the noise-related input level, a threshold value related to a volume of an input signal set based on measurement of current external noise may be displayed, and settings related to the volume of the input signal of the user may be changeable based on the threshold value. The display may be configured to display a score in which a note is generated for each measure within a predetermined time range based on a humming input of the user.

The humming melody of the user may be performed using the record button through a first recording in a first section and a second recording in a second section which is discontinuous to the first section. The apparatus may further include a melody connection processor configured to determine whether a melody at a last portion of the first recording is similar to a melody at a front portion of the second recording. Here, the melody connection processor may be configured to determine whether the melody at the last portion of the first recording is similar to the melody at the front portion of the second recording based on at least one of a vocal range, a chord, a rhythm, and melody pattern information.

The melody connection processor may be configured to connect the melody at the last portion of the first recording to the melody at the front portion of the second recording by correcting at least one of the melody at the last portion of the first recording and the melody at the front portion of the second recording, in response to determination that the melody at the last portion of the first recording is similar to the melody at the front portion of the second recording. Further, the melody connection processor may be configured to add a bridge including at least one measure between the melody at the last portion of the first recording and the melody at the front portion of the second recording, in response to determination that the melody at the last portion of the first recording is not similar to the melody at the front portion of the second recording.

Additional aspects of example embodiments will be set forth in part in the description which follows and, in part, will be apparent from the description, or may be learned by practice of the disclosure.

Effects

According to an example embodiment, a method and apparatus that may enable an ordinary person not having expert knowledge to easily compose natural music by automatically providing a score and an accompaniment suitable for a humming melody of a user based on the humming melody may be provided.

According to an example embodiment, a method and apparatus for providing a melody recording based on a humming melody of a user that has a user interface (UI) to increase a user convenience when recording the humming melody of the user may be provided.

According to an example embodiment, a method and apparatus for providing a melody recording based on a humming melody of a user that may more naturally connect humming melodies of the user that are recorded discontinuously may be provided.

According to an example embodiment, a method and apparatus for providing a melody recording based on a humming melody of a user that may induce a user to pay by inserting a signature sound into a music source based on a generated accompaniment score may be provided.

According to an example embodiment, a method of providing and correcting accompaniment information more intuitively and conveniently by providing an accompaniment pattern for a plurality of musical instruments using a dice dot pattern may be provided.

The effects obtainable from the present disclosure are non-limited by the above-mentioned effects. And, other unmentioned effects can be clearly understood from the following description by those having ordinary skill in the technical field to which the present disclosure pertains.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
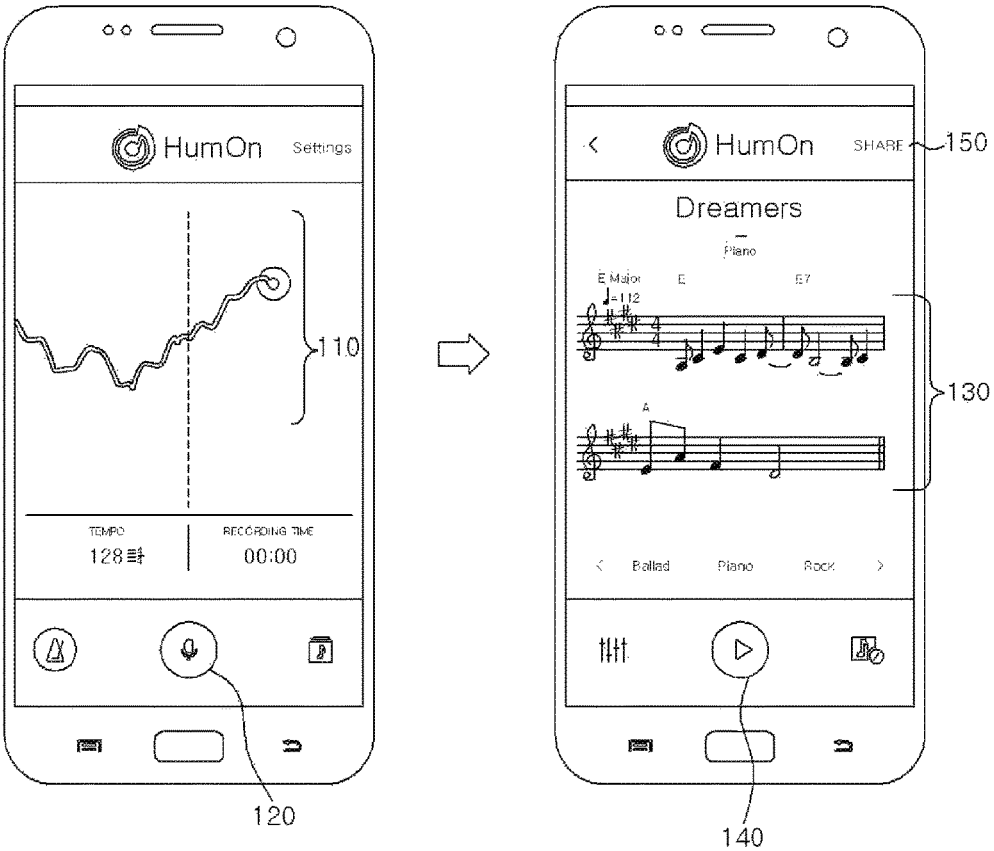
FIG. 1 illustrates an example of a method and apparatus for providing an accompaniment based on a humming melody of a user according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. In drawings, parts irrelevant to the description are omitted for the simplicity of explanation, and like reference numerals denote like parts through the whole document.

The terminology used herein is for the purpose of describing particular example embodiments only and is not intended to be limiting. As used herein, the singular forms "a," "an," and "the," are intended to include the plural forms as well, unless the context clearly indicates otherwise.

It will further be understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

In addition, terms such as first, second, A, B, (a), (b), and the like may be used herein to describe components. Each of these terminologies is not used to define an essence, order or sequence of a corresponding component but used merely to distinguish the corresponding component from other component(s). Also, in the description of example embodiments, detailed description of well-known related structures or functions will be omitted when it is deemed that such description will cause ambiguous interpretation of the present disclosure.

Furthermore, constituent units included in example embodiments of the present disclosure are independently illustrated to describe different specific functions, and each of the constituent units may not indicate separate hardware or one software element. That is, the respective constituent units are arranged and included for convenience of description. Among the constituent units, two or more constituent units may be combined to serve as one constituent unit, and one constituent unit may be divided into a plurality of constituent units to perform a function. The integrated example embodiment of the constituent units and the divided example embodiments of each constituent unit are included in the claims as long as they do not depart from the spirit of the present disclosure.

Hereinafter, example embodiments will be described in detail with reference to the accompanying drawings. The configuration and effects thereof can be clearly understood from the following description.

FIG. 1 illustrates an example of a method and apparatus for providing an accompaniment based on a humming melody of a user according to an example embodiment.

A left image of FIG. 1 illustrates a display of a user device that receives a melody being input through a user voice or humming. A user may start a humming or voice input by touching a record button 120, and changes in pitches may be displayed in real time on a main screen 110 based on the melody input from the user. The changes in the pitches may be displayed using various methods. Hereinafter, detailed example embodiments thereof will be described. Further, a tempo of the melody may be displayed using a beat per minute (BPM) value on the display of the user device, and a recording time may be displayed together.

When the input of the user melody is terminated, the user device may analyze and correct the melody and convert the melody into a score, automatically generate an accompaniment of chords harmonizing therewith, and display a completed score on a main screen 130. Further, a music genre may be displayed and selected through the display of the user device, and the user may start a play of the completed score by touching a music play button 140.

Further, the user may share the composed score easily with other media of the user or other people through a share button 150 displayed on the user display, for example, send an email, post on a blog, post on a social network service (SNS), store in a memo pad, or share with friends.

Hereinafter, an apparatus and method for providing an accompaniment based on a humming melody of a user that may generate an accompaniment and a score that are suitable for intent of the user and most natural to provide an accompaniment based on a melody such as a humming input by the user will be described further.

Figure 2:
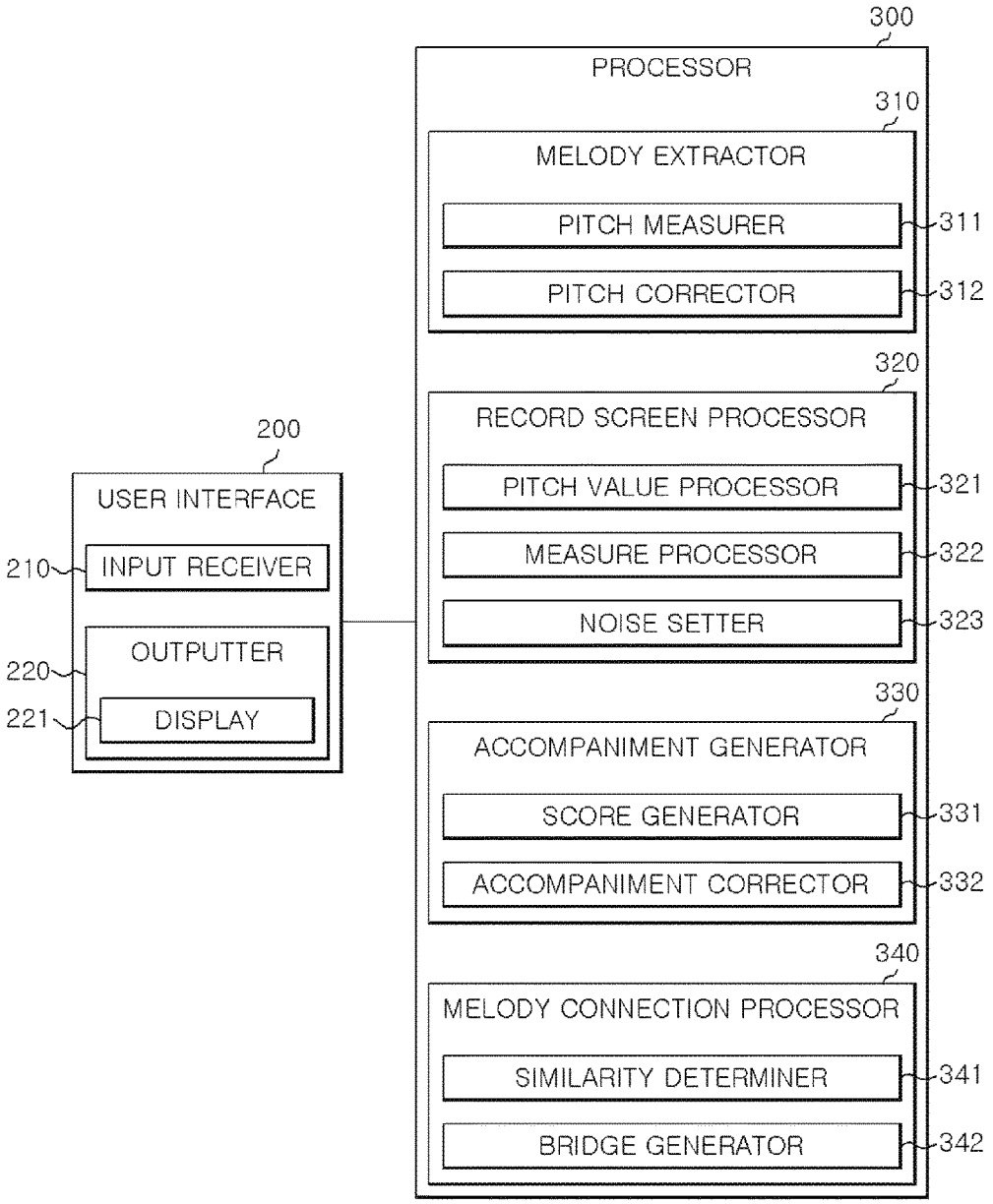
FIG. 2 is a block diagram illustrating a configuration of an apparatus for providing an accompaniment based on a humming melody of a user according to an example embodiment.

FIG. 2 is a block diagram illustrating a configuration of an apparatus for providing an accompaniment based on a humming melody of a user according to an example embodiment. The apparatus for providing an accompaniment based on a humming melody of a user may have a user melody recording function.

First, the apparatus for providing an accompaniment based on a humming melody of a user may be a terminal configured to receive, process, and display various data via wired and wireless communication networks in response to input and output controls of the user, and may be, for example, one of a smart phone, a tablet computer, a desktop computer, a laptop computer, a notebook computer, a workstation, a personal digital assistant (PDA), a portable computer, a wireless phone, a mobile phone, an e-book, a portable multimedia player (PMP), a portable game console, a navigation system, a black box, a digital camera, a television, a wearable device, a voice recognition speaker, a smart speaker, and an artificial intelligence (AI) speaker. However, the example embodiments are not limited thereto.

Referring to FIG. 2, the apparatus for providing an accompaniment based on a humming melody of a user may include a user interface 200 and a processor 300.

The user interface 200 may include, as constituent elements configured to perform an input and an output from and to a user, an input receiver 210 configured to receive various inputs from the user using various methods, and an outputter 220 configured to perform various outputs using various methods. Further, the input receiver 210 and the outputter 220 may be configured as separate constituent elements, or may be configured as a single integrated constituent element.

The input receiver 210 may include a microphone configured to receive an input of a voice or a humming melody of the user, and may include an inputter including at least one of a touch pad, a touch panel, a key pad, a dome switch, a physical button, a jog shuttle, and a sensor to receive various inputs for control and selection of the user. However, the example embodiments are not limited thereto.

The outputter 220 may include a speaker configured to output a play of an accompaniment generated based on the humming melody of the user, and a display 221 configured to visually provide the user with a screen to provide a recording function, a score of the accompaniment and a variety of related information. Here, the display 221 may include, for example, a liquid crystal display (LCD), a light emitting diode (LED) display, an organic LED (OLED) display, a micro LED, a micro electro mechanical system (MEMS) display, and an electronic paper display. However, the example embodiments are not limited thereto. Further, the display 221 may be implemented in a form of a touch screen by being combined with the input receiver 210.

The processor 300 may perform various control and processing operations of the apparatus for providing an accompaniment based on a humming melody of a user, and perform data processing or operations related to communication and control of the plurality of constituent elements. For example, the processor 300 may include a central processing unit (CPU) and an application processor (AP), and may include a memory configured to store data or instructions related to one or more other constituent elements or may communicate with an external memory to access required information, as necessary.

The processor 300 may include a melody extractor 310, a record screen processor 320, an accompaniment generator 330, and a melody connection processor 340. The constituent elements may be implemented in an integral form, as necessary. The melody extractor 310, the record screen processor 320, the accompaniment generator 330, and the melody connection processor 340 may be in the form of operating systems, application program modules, or other program modules, while they may be physically stored on a variety of commonly known storage devices (e.g., the memory of the processor 300). Such program modules may include, but not limited to, routines, subroutines, programs, objects, components, instructions, data structures, and the like for performing specific tasks or executing specific abstract data types as will be described below in accordance with the present disclosure.

The melody extractor 310 of the processor 300 may be configured to measure a pitch from the humming melody of the user received through the input receiver 210. The melody extractor 310 may include a pitch measurer 311 and a pitch corrector 312. The pitch measure 311 and the pitch corrector 312 may be in the form of, for example, routines, subroutines, programs, objects, components, instructions, data structures, and the like for performing specific tasks or executing specific abstract data types as will be described below in accordance with the present disclosure. The pitch measurer 311 may be configured to measure the pitch of the humming melody received from a user. The melody extractor 310 may measure the pitch of the humming melody of the user in real time, and display the measured pitch in real time through the display 221 of the outputter 220 such that the user may verify a change in the pitch in real time.

The pitch corrector 312 of the processor 300 may be configured to wholly or partially correct a shaking of a melody line or a pitch of a melody prejudiced or biased in one direction from the received melody.

Each user has a unique sense of pitch and a unique style, and thus the pitch corrector 312 may discern and correct a unique bias due to an individual difference that may appear at a beginning or an end of music or in whole music. For example, some users may sing each note of a corresponding scale wholly consistently with a slightly high pitch or with a slightly low pitch. In this example, an overall pitch correction may be performed. Further, in a case of mismatching with a pitch of each note of the corresponding scale due to an unstable humming in a portion of a section rather than the whole section, a pitch correction may be performed with respect to the portion of the section. The pitch corrector 312 may discern a bias tendency of each user by storing and managing information related to a bias correction for each user, and perform a user customized melody pitch correction by discerning intent of the user more accurately based on past data accumulated as described above. Thus, as a user iteratively generates accompaniments with a predetermined pattern, a bias pattern of the user may be discerned more accurately, and thus a bias correction suitable for intent of the user may be performed more accurately.

The record screen processor 320 may be configured to process various control and processing operations to provide an interface for recording a melody of the user through the outputter 220 of the user interface 200. The record screen processor 320 may include a pitch value processor 321, a measure processor 322, and a noise setter 323. The pitch value processor 321, the measure processor 322, and the noise setter 323 may be in the form of, for example, routines, subroutines, programs, objects, components, instructions, data structures, and the like for performing specific tasks or executing specific abstract data types as will be described below in accordance with the present disclosure.

The record screen processor 320 may generate a record button to start recording of the humming melody in response to an input of the user on a screen of the user device, and also a pitch displaying region to display a change in the pitch measured and recognized by a pitch measurer 311 and a pitch corrector 312 in real time on the display 221, through the pitch value processor 321.

Further, the record screen processor 320 may perform processing to display a grid region on an upper portion of the record screen to indicate a measure through the measure processor 322. The grid region displayed on the upper portion of the record screen may be displayed to not overlap the pitch displaying region, and a measure indicating grid may be processed to run leftward over time.

The record screen processor 320 may display a button to set a melody input level related to a noise level in a pitch tuning operation or an operation before recording, and include the noise setter 323 configured to set the noise-related input level.

The user may provide an input with respect to the nose-related input level setting button displayed on the display 221, thereby setting a user input level on a noise-related input level setting region. Basically, a minimum volume value of a melody input required for the user input may be displayed on the noise-related input level setting region based on a threshold value related to a volume of an input signal set based on a measurement of current external noise through the noise setter 323, that is, a current level of external noise. Further, the noise setter 323 may provide the user with a setting function to change settings related to the volume of the input signal in a range over the threshold value based on the provided threshold value.

The accompaniment generator 330 may generate an accompaniment based on the humming melody of the user received through the input receiver 210. The accompaniment generator 330 may include a score generator 331 and an accompaniment generator 332. The score generator 331 and the accompaniment generator 332 may be in the form of, for example, routines, subroutines, programs, objects, components, instructions, data structures, and the like for performing specific tasks or executing specific abstract data types as will be described below in accordance with the present disclosure. In detail, to generate an accompaniment and a score that are suitable for intent of the user and most natural, an accompaniment correction may be reflected based on pitch bias correction, key extraction, chord extraction, and tempo (BPM) measurement from the input user melody, whereby a final accompaniment may be generated. Further, the accompaniment generator 330 may change or correct the generated accompaniment through the accompaniment corrector 332.

The score generator 331 may be configure to generate and display a score based on the generated accompaniment, and generate and display a score for each musical instrument based on the accompaniment and the melody generated by being corrected finally through the accompaniment correcting operation. For example, scores of various forms may be generated based on various musical genres or user settings and displayed using various methods.

The melody connection processor 340 may process the melody to naturally connect a melody at a last portion of a first section and a melody at a front portion of a second section when the humming melody of the user is discontinuously provided, for example, when a recording in each of the first section and the second section that are discontinuous is completed by utilizing a record pause and restart function.

The melody connection processor 340 may include a similarity determiner 341 and a bridge generator 342. The similarity determiner 341 and the bridge generator 342 may be in the form of, for example, routines, subroutines, programs, objects, components, instructions, data structures, and the like for performing specific tasks or executing specific abstract data types as will be described below in accordance with the present disclosure.

The similarity determiner 341 may determine a similarity between a melody obtained through a first recording in the first section and a melody obtained through a second recording in the second section, the first section and the second section being discontinuous. For example, by determining whether a melody at a last portion of the first recording is similar to a melody at a front portion of the second recording, whether the melodies are similar and a similarity therebetween may be determined.

The similarity determiner 341 may determine whether the melodies are similar based on at least one of vocal ranges, chords, rhythms, and melody pattern information of the melodies. In detail, measured values of the melodies may be compared based on 1) vocal range measurement, 2) determination of proportions of stable notes and unstable notes of melody constituent sounds, 3) melody progression, for example, measurement of leaping and approaching method, 4) melody shape measurement, 5) melody breath, rhythm measurement (quarter, eighth, or sixteenth note), 6) motive and variation measurement (melody pattern), and 7) melody chord information of the melodies, and determine whether the melodies are similar through a combination thereof.

In particular, in a case of the melody chord information, the similarity between the melodies may be determined through 1) triad, 7th chord, whether a tension is produced, and frequency measurement, and 2) an analysis of the number of chords in each measure.

When the similarity determiner 341 determines that the melody of the first recording is similar to the melody of the second recording, the melody connection processor 340 may perform a correcting operation to connect the melody at the last portion of the first recording to the melody at the front portion of the second recording more naturally by correcting at least one of the melody at the last portion of the first recording and the melody at the front portion of the second recording.

Further, in response to determination that the melody of the first recording is not similar to the melody of the second recording, the bridge generator 342 of the melody connection processor 340 may generate a bridge or a transition including at least one measure between the melody at the last portion of the first recording and the melody at the front portion of the second recording. By generating the bridge to act as a transition bridge between the non-similar melodies and inserting the bridge between the melody of the first recording and the melody of the second recording, an unnatural connection of the melodies that may be caused by discontinuous recordings may be modified more naturally by inserting the bridge.

Through the melody connection composition as described above, a method and apparatus for providing an accompaniment based on a humming melody of a user that may more naturally connect melodies that are recorded discontinuously due to a schedule or personal reason of the user may be provided.

Figure 3:
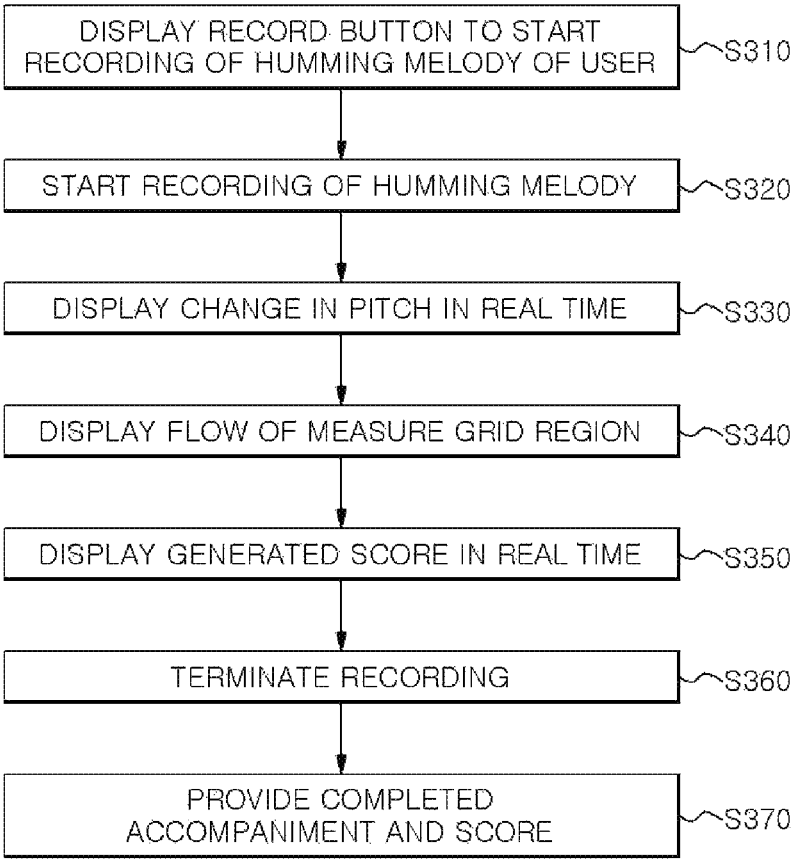
FIG. 3 is a flowchart illustrating a method of providing a melody recording based on a humming melody of a user according to an example embodiment.

FIG. 3 is a flowchart illustrating a method of providing a melody recording based on a humming melody of a user according to an example embodiment.

Referring to FIG. 3, in operation S310, a record button to start recording of a humming melody of a user may be displayed on a user screen. A user may initiate recording by providing an input, for example, by touching the record button displayed on the user screen.

In operation S320, when the recording of the humming melody of the user is started, a humming melody signal of the user may be received.

In this example, a pitch value may be measured in real time from the received humming melody. In operation S330, a change in a pitch may be displayed in real time based on the measured pitch value. In operation S340, a grid region indicating a measure may be displayed on an upper portion of a record screen. The grid region displayed on the record screen may be displayed to not overlap a region in which the change in the pitch is displayed. A measure indicating grid may be displayed to run leftward over time.

In operation S350, a score generated based on the received humming melody may be displayed in real time while displaying the change in the pitch in real time. For example, when the score is generated in a unit of a predetermined number of measures through melody extraction, for example, pitch value recognition, the generated score may be displayed on the user screen together with the pitch displaying region.

In operation S360, the recording may be terminated in response to an input of the user. When the recording is terminated, an accompaniment and a score completed based on the generated accompaniment may be provided, in operation S370. The completed score may be displayed for each musical instrument. Based on a user selection, a function to play the score through the outputter 220 may also be included.

A portion of the operations in the flowchart may be omitted, performed in a different order, or performed iteratively as necessary.

Figure 4:
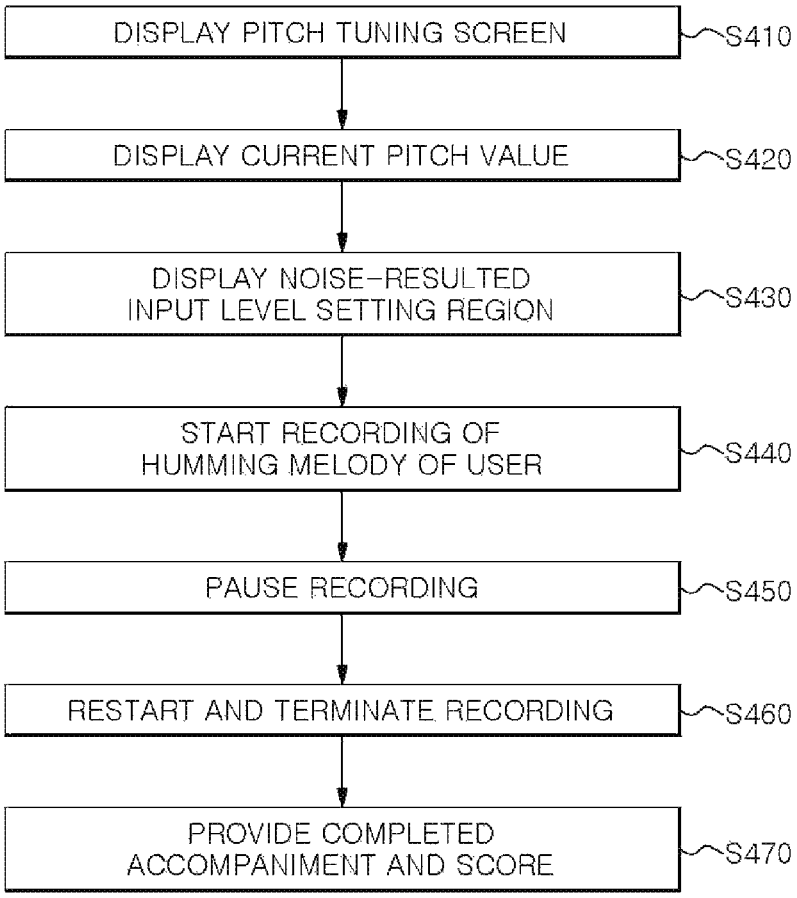
FIG. 4 is a flowchart illustrating a method of providing a melody recording based on a humming melody of a user according to another example embodiment.

FIG. 4 is a flowchart illustrating a method of providing a melody recording based on a humming melody of a user according to another example embodiment. User humming melody recording by the method of FIG. 4 may be accompanied with recording performed discontinuously.

Referring to FIG. 4, in operation S410, a pitch tuning screen may be displayed on a user device before recording. A user may need to verify whether a pitch value is measured and recognized as intended before starting the recording. For this, in operation S420, a pitch value currently input by the user may be displayed on a screen of the user device. The user may complete tuning of the pitch of the user based on the pitch value displayed on the screen.

In operation S430, a noise-related input level setting region may be displayed on the user screen. The user may verify, on the noise-related input level setting region, a minimum volume value of a melody input required for the user input based on a threshold value related to a volume of an input signal set based on a measurement of current external noise, that is, a current level of external noise. Further, the user may change threshold settings related to the volume of the input signal in a range over the threshold value.

In operation S440, recording of a humming melody of the user may be started after the user completes the setting operation before the recording as described above.

In operation S450, the user may pause the recording as necessary. The user may pause the recording using a pause button, and restart the recording when recording is possible.

In operation S460, the recording may be finally terminated after the user restarts the recording. When the recording is terminated, an accompaniment and a score completed based on the generated accompaniment may be provided. The completed score may be displayed for each musical instrument. Based on a user selection, a function to play the score may also be included.

A portion of the operations in the flowchart may be omitted, performed in a different order, or performed iteratively as necessary.

Figure 5A:
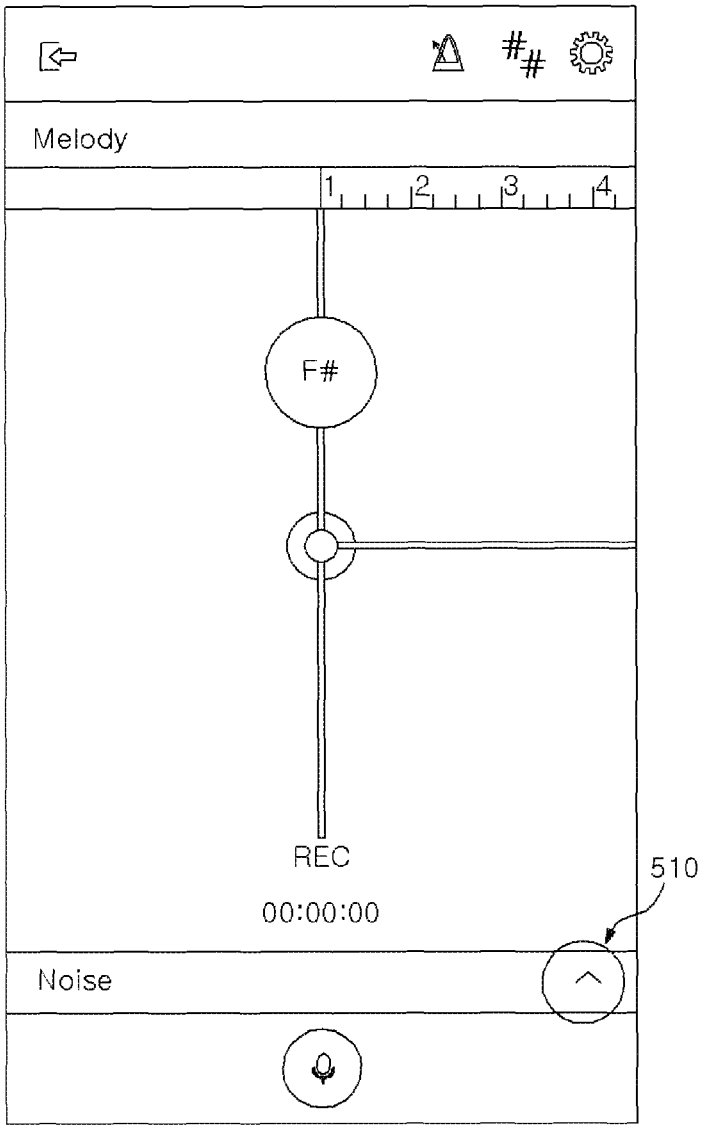
FIGS. 5A and 5B illustrate an example of a screen before recording in an apparatus for providing a melody recording based on a humming melody of a user according to an example embodiment.
Figure 5B:
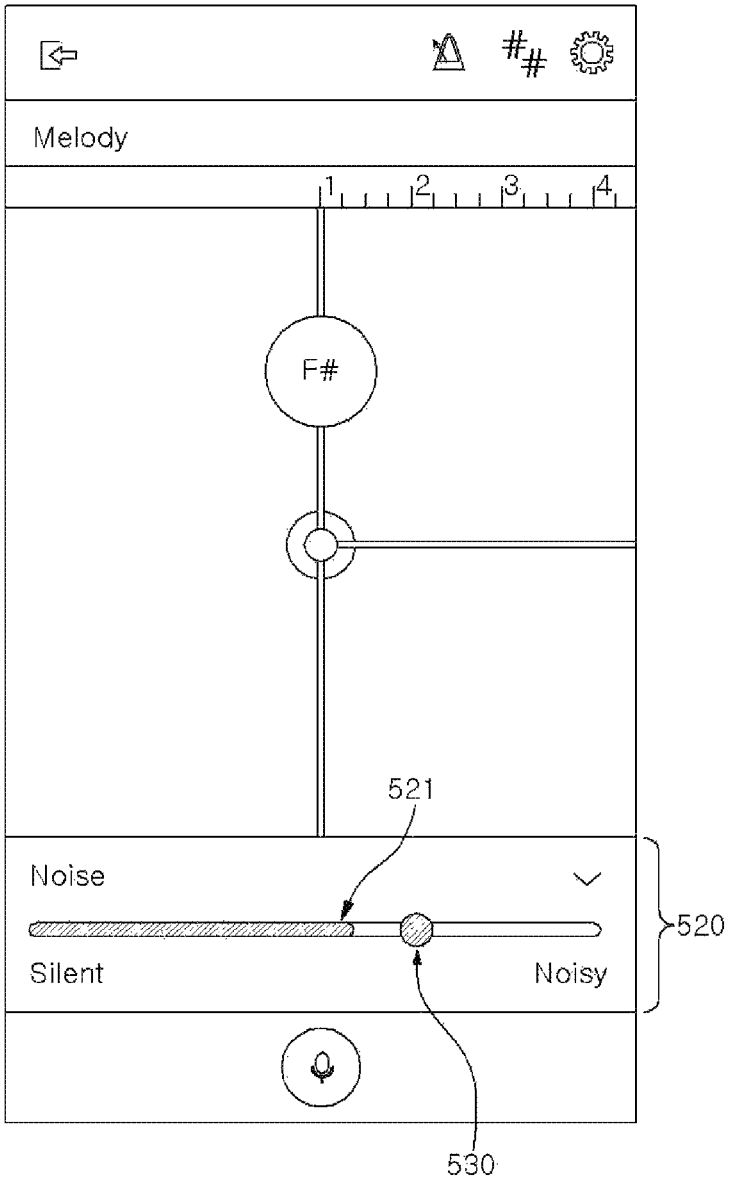

FIGS. 5A and 5B illustrate an example of a screen before recording in an apparatus for providing a melody recording based on a humming melody of a user according to an example embodiment.

FIG. 5A illustrates a screen of an operation before melody recording. A user may provide an input with respect to a button 510 to set a noise-related input level at a bottom of the screen, thereby moving to a region to verify and set the noise-related input level.

FIG. 5B illustrates an example of a noise-related input level setting region. A noise-related input level setting region 520 activated and displayed in response to an input of the user may basically include a bar 521 indicating a threshold value related to a volume of an input signal set based on a measurement of current external noise. For example, a length of the bar 521 may indicate a minimum volume of the user input based on a level of the current external noise, and an end of the bar 521 may indicate a threshold value which is the minimum volume required by the user. When the user provides a melody input of a volume higher than or equal to the displayed threshold value, the recording may be performed normally. The user may additionally designate a user setting value 530 as a reference value within a range over the threshold value, so as to receive an input reference of a volume higher than the noise level.

Figure 6:
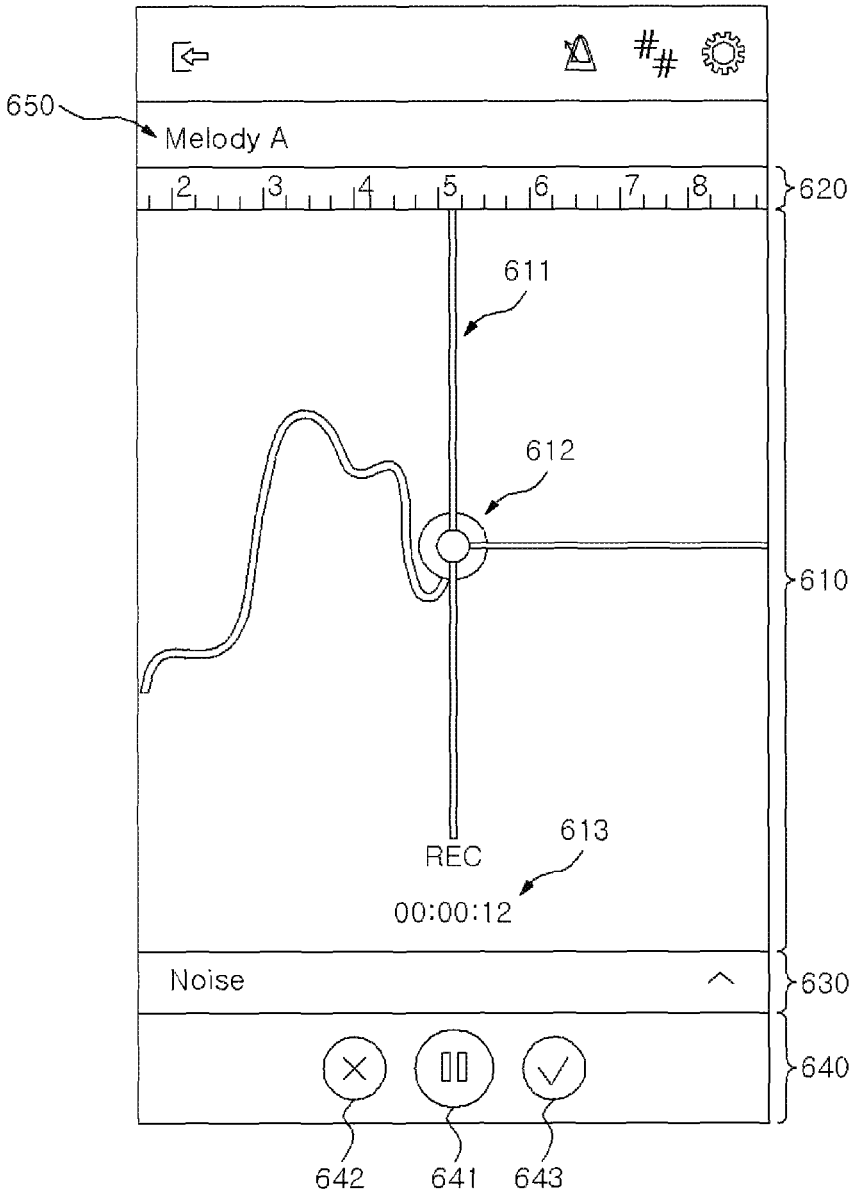
FIG. 6 illustrates an example of a screen during recording in an apparatus for providing a melody recording based on a humming melody of a user according to an example embodiment.

FIG. 6 illustrates an example of a screen during recording in an apparatus for providing a melody recording based on a humming melody of a user according to an example embodiment.

Referring to FIG. 6, a screen displayed on a user device during recording of a user may include a pitch displaying region 610 configured to display a change in a pitch in real time, a measure region 620 configured to indicate a flow of measures of the recording, a noise setting input region 630 configured to perform noise-related input settings, a user input region 640 configured to select a recording related input, and a name indicating region 650 configured to indicate a name of a melody currently being recorded.

The pitch displaying region 610 may include a reference line 611 that is provided in a vertical direction at a center of the screen of the user device. Changes in a pitch measured within a predetermined period from a current point in time may be displayed only on a left side of the vertical reference line 611. Thus, the current point in time may be recognized through the vertical reference line 611, and real-time changes in the pitch of the recorded melody may be displayed on the left side of the reference line 611. By displaying a right side of the reference line 611 to be blank or displaying a horizontal line on the right side of the reference line 611, the right side of the reference line 611 may be intuitively recognized as a portion in which recording is not performed currently.

Further, a pitch value at the current point in time may be displayed in real time through a point 612 that moves up and down within the reference line 611 based on a size thereof. A current pitch may be indicated using a character or a grid to be adjacent to the point 612 indicating the current pitch. In addition, a height of the point 612 indicating the current pitch within the reference line 611 may be fixed to a center of the reference line 611, and the pitch already recorded and displayed on the left side may be changed in real time based on the center point. In this example, the real-time changes in the pitch may be displayed up and down based on the pitch of the melody at the current point in time at all times.

The pitch displaying region 610 may further include a time indicator 613 configured to indicate an amount of time elapsed for the current recording at a bottom of the pitch displaying region 610.

The measure region 620 configured to display a measure may be displayed on the top of the pitch displaying region 610 to indicate a flow of measures of the recording. A measure grid shown in the measure region 620 may be displayed to start from, for example, "1" and run leftward over time as the recording is continued. A current measure at the current point in time may be verified based on a grid that meets the reference line 611.

The measure region 620 including a grid region may be configured to be disposed adjacent to the pitch displaying region 610 displaying the changes in the pitch, without overlapping, whereby the user may intuitively verify a flow of the current measure in real time.

As shown in FIG. 5A, the user screen may further include the noise setting input region 630 to perform noise-related input settings during the recording, and the noise-related input level setting region may be activated through an input with respect to the noise setting input region 630.

The user screen may further include the user input region 640 configured to select a recording-related input. The user input region 640 may include a start/pause button 641 configured to input a start, a pause, and a restart of recording, a cancel button 642 configured to cancel recording, and an end button 643 configured to end recording. The user may end the recording using the end button 643, and pause and restart recording using the start/pause button 641.

Here, the start/pause button 641 may be configured to continue or pause the recording based on whether the user maintains an input with respect to a record button. That is, the recording may be performed only when the user maintains the input with respect to the start/pause button 641, and the recording may be paused when the user releases the start/pause button 641. In this example, the user may continue the recording through another input with respect to the start/pause button 641. When the recording is completed, the user may end the recording through an input with respect to the end button 643. The user may cancel the recording through an input with respect to the cancel button 642. When the user stops the recording using the cancel button 642 during the recording, content recorded up to the current point in time may be deleted.

The user screen may further include the name indicating region 650 indicating a name of the melody currently being recorded. Through the name indicating region 650, the user may verify a name of a file currently being recorded.

Figure 7A:
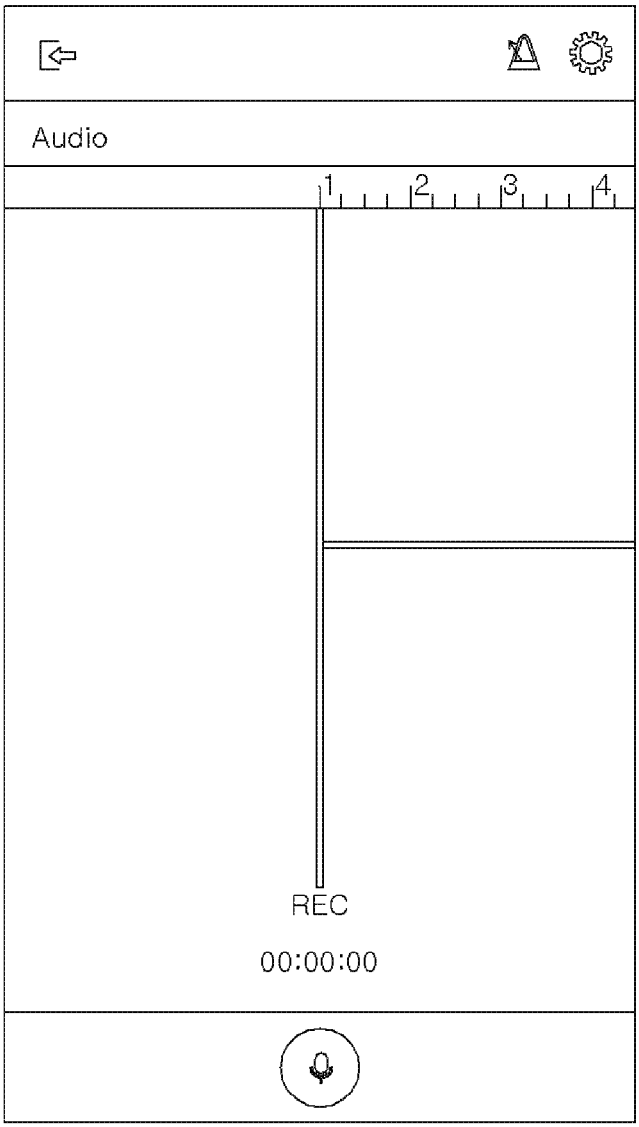
FIGS. 7A and 7B illustrate an example of a screen displaying a waveform size of a sound based on a humming melody of a user according to an example embodiment.
Figure 7B:
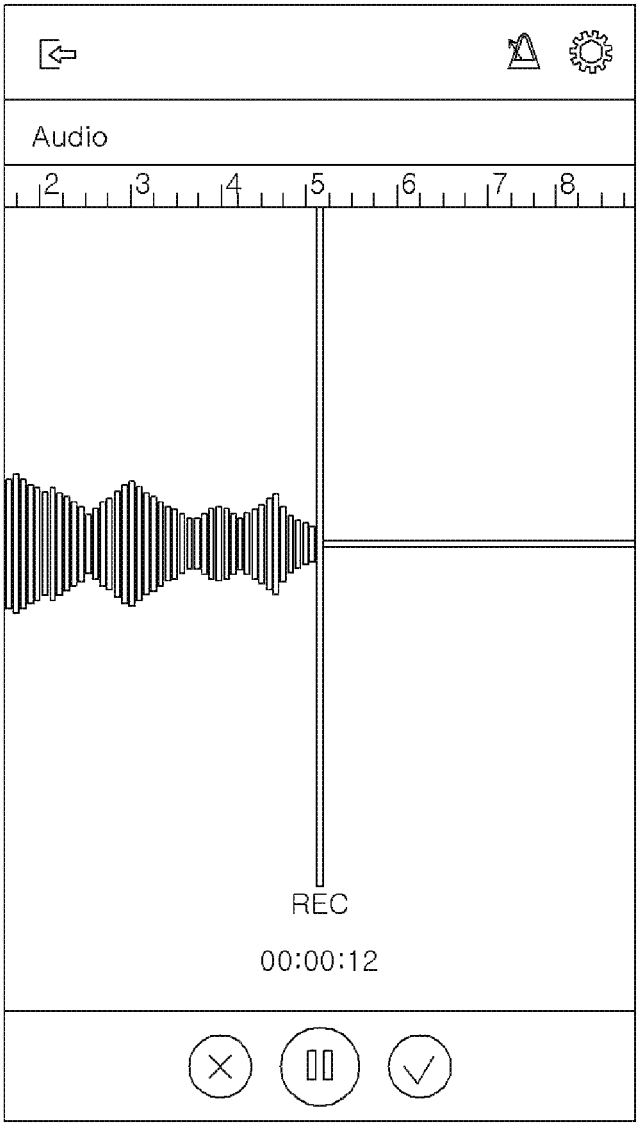

FIGS. 7A and 7B illustrate an example of a screen displaying a waveform size of a sound based on a humming melody of a user according to an example embodiment.

FIG. 7A illustrates a screen before recording, and FIG. 7B illustrates a screen displaying a waveform size of a sound during recording. Referring to FIG. 7B, a waveform displayed on a left side of a vertical reference line indicating a current point in time may represent a waveform size of a recorded sound. By indicating the waveform size of the recorded sound, a change in a volume of a sound of the user may be verified in real time.

The screen of FIG. 7B displaying the change in the waveform size may be displayed together with the screen of FIG. 6 displaying the change in the pitch. In this example, the waveform size screen and the pitch screen may be disposed to not overlap.

Figure 8A:
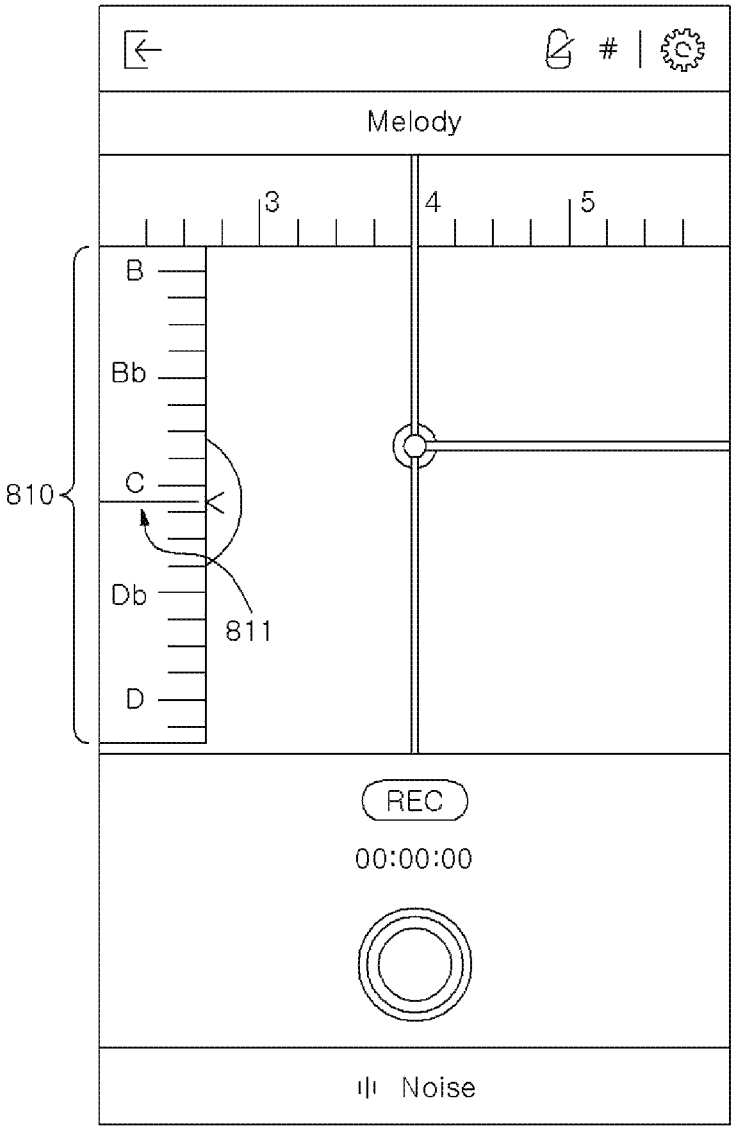
FIGS. 8A and 8B illustrate an example of a pitch tuning screen before recording in an apparatus for providing a melody recording based on a humming melody of a user according to an example embodiment.
Figure 8B:
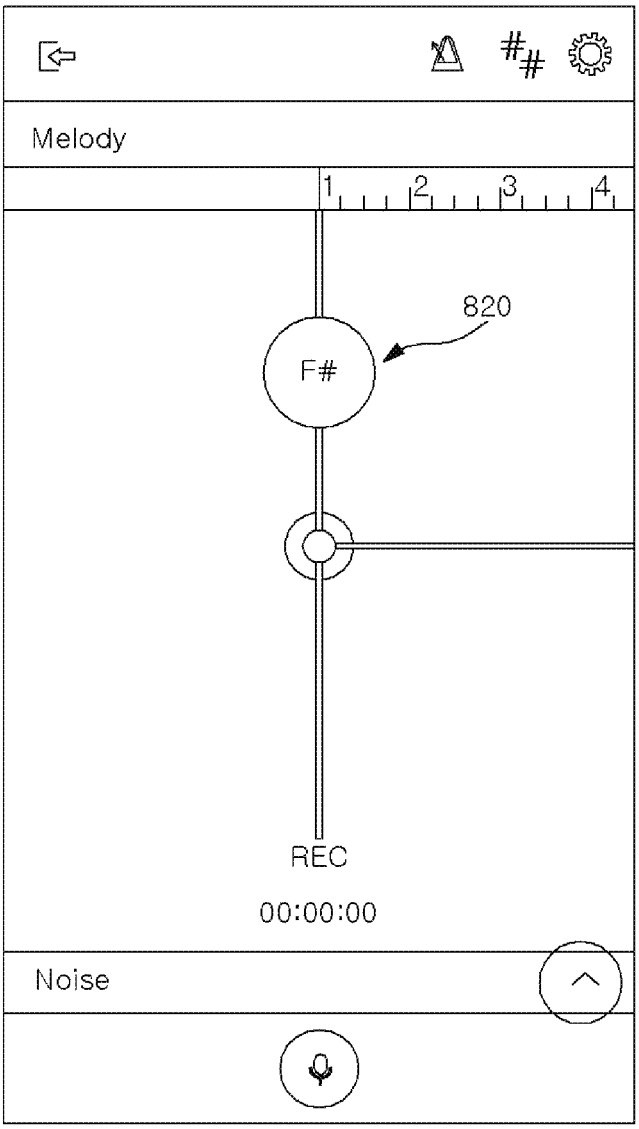

FIGS. 8A and 8B illustrate an example of a pitch tuning screen before recording in an apparatus for providing a melody recording based on a humming melody of a user according to an example embodiment.

FIG. 8A illustrates an example of a screen indicating a pitch of a sound of a user currently being input and measured using a grid region 810 for pitch tuning before melody recording. A gradation 811 corresponding to a current pitch may be indicated on the grid region 810 based on a measurement of the current pitch. For example, the user may verify through the pitch tuning screen that the current pitch is close to C, and may perform a process of verifying whether the pitch measurement is performed as intended and tuning the pitch. Further, since the current pitch is indicated on the grid region 810, a change in the pitch may be intuitively recognized.

FIG. 8B illustrates an example of a screen indicating a pitch of a sound of a user currently being input using a character for pitch tuning before melody recording. In the example of FIG. 8B, a measured value 820 of the pitch may be indicated using a character F#, rather than the grid region, based on the current voice input of the user.

Figure 9:
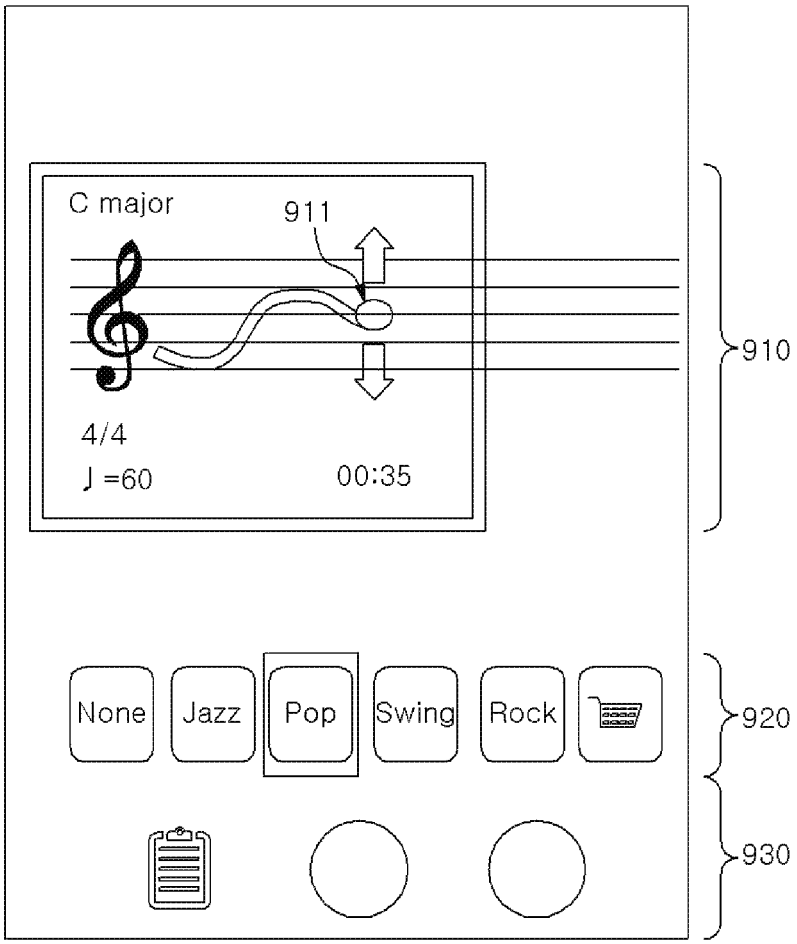
FIG. 9 illustrates an example of a screen displaying a real-time score during recording in an apparatus for providing a melody recording based on a humming melody of a user according to an example embodiment.

FIG. 9 illustrates an example of a screen displaying a real-time score during recording in an apparatus for providing a melody recording based on a humming melody of a user according to an example embodiment.

Referring to FIG. 9, a score 910 in which a note is generated for each measure within a predetermined time range based on a humming input of a user may be displayed. In the generated score 910, a pitch of a melody currently being input may be displayed using a note 911 on a manuscript paper in the score 910.

A note to be displayed in the score 910 may be determined based on a time and a tempo (BPM) value predetermined by an analysis of a recorded melody or a user input. Sounds recognized to have changes in pitch values may be formed in a unit of a predetermined number of measures and displayed by being converted to notes in measures of the score 910 after a predetermined period elapses.

The score 910 generated in real time and the pitch displaying region 610 of FIG. 6 may be displayed simultaneously to not overlap. In this example, the user may verify the change in the pitch in real time, and simultaneously verify the score generated in a unit of a predetermined number of measures.

In addition, the user may select a desired genre through a genre selection region 920 on the user screen, and perform an input to start recording, pause recording, end recording, or retrieve a list through an input button region 930.

Figure 10:
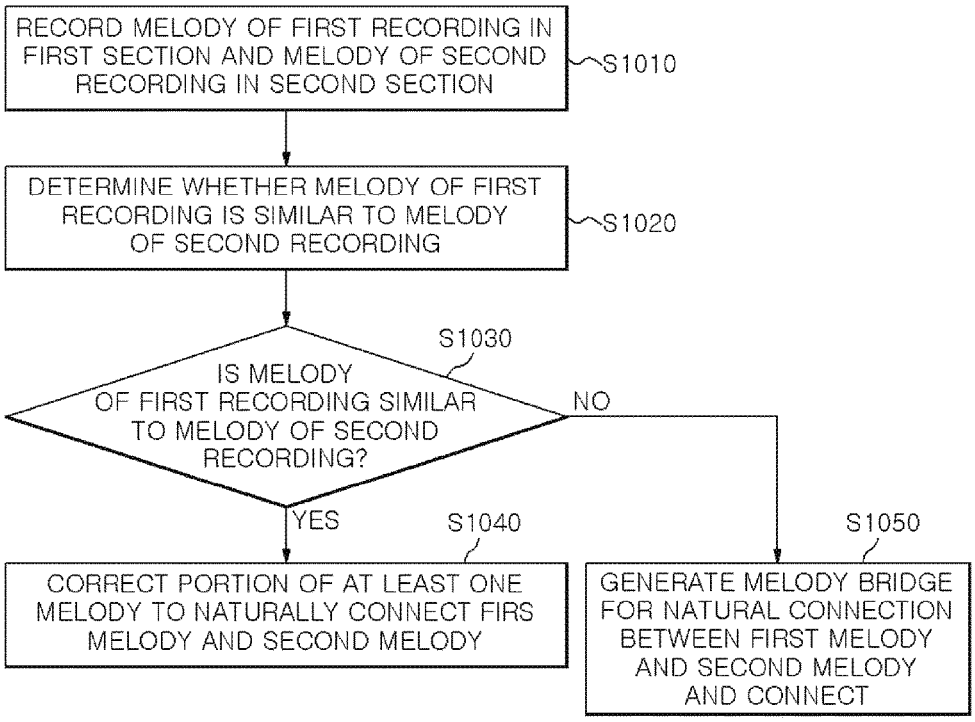
FIG. 10 is a flowchart illustrating an operation of processing connection of discontinuous melodies according to an example embodiment.

FIG. 10 is a flowchart illustrating an operation of processing connection of discontinuous melodies according to an example embodiment.

Referring to FIG. 10, in operation S1010, a melody of a first recording in a first section and a melody of a second recording in a second section may be recorded, the first section and the second section being discontinuous. A user may first record a partial melody of whole music, and continuously record a remaining melody later through a recording pause function. At least two discontinuous partial recordings may be performed, and may be automatically connected sequentially based on time information related to the recordings.

In operation S1020, the similarity determiner 341 of the melody connection processor 340 may determine a similarity between the melody of the first recording in the first section and the melody of the second recording in the second section and whether the melodies are similar. In this example, whether the melodies are similar may be determined by selectively comparing a last portion of the melody of the first recording to a first portion of the melody of the second recording to be connected, rather than comparing the entire melody of the first recording to the entire melody of the second recording.

In operation S1030, the similarity determiner 341 of the melody connection processor 340 may determine whether the melody of the first recording is similar to the melody of the second recording through the comparison of the melodies. Whether the melodies are similar may be determined by comparing various measured values to determine whether the melodies are similar, and determining whether the similarity between the melodies is greater than or equal to a predetermined criterion.

In response to determination that the melodies are similar, the second melody may be connected directly to the first melody. In operation S1040, a portion of at least one of the first melody and the second melody may be corrected to naturally connect the second melody to the first melody. For example, by correcting at least a portion of a last measure of the first melody or at least a portion of a first measure of the second melody, a portion of the melodies or a pitch of a portion of sounds may be modified for more natural connection.

Meanwhile, in response to determination that the melodies are not similar, the bridge generator 342 of the melody connection processor 340 may generate a melody bridge for natural connection between the first melody and the second melody, and insert the melody bridge between the melodies, in operation S1050. The melody bridge may be inserted between the last measure of the first melody and the first measure of the second melody. The melody bridge may include at least one measure, for example, four measures or eight or fewer measures.

Figure 11A:
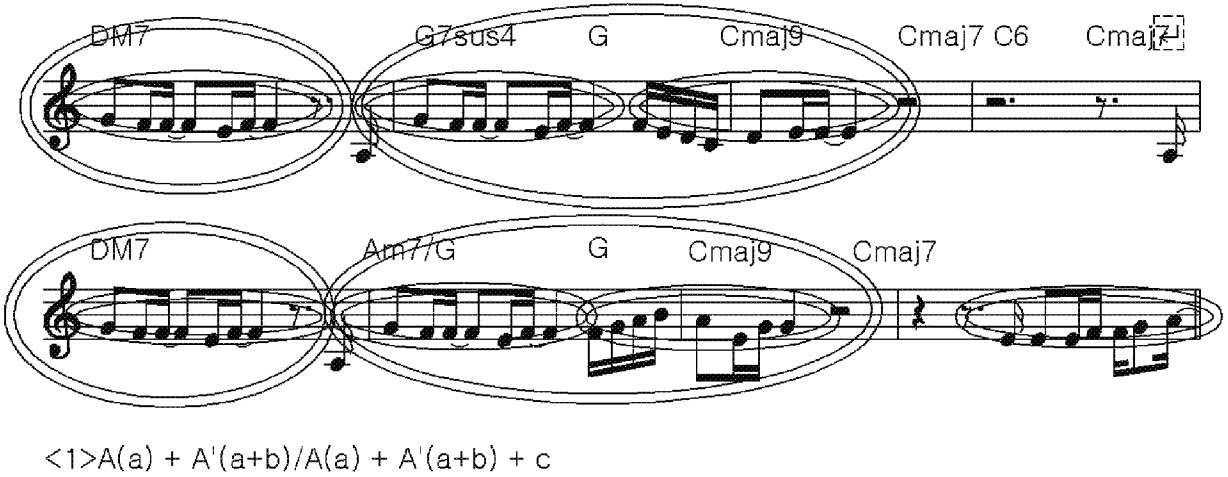
FIGS. 11A and 11B illustrate examples of scores to describe determination of a similarity between discontinuous melodies according to an example embodiment.
Figure 11B:
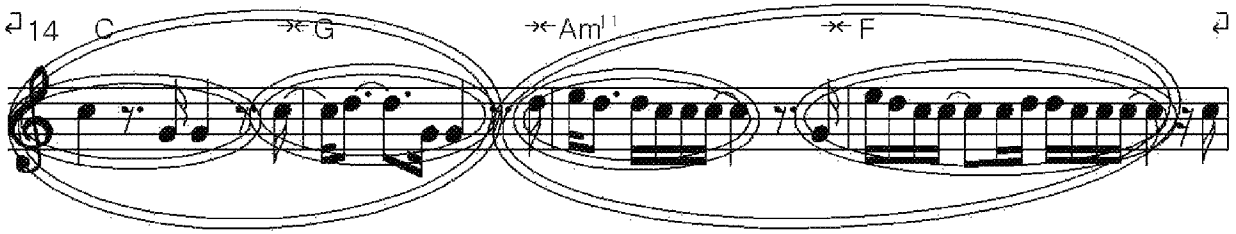

FIGS. 11A and 11B illustrate examples of scores to describe determination of a similarity between discontinuous melodies according to an example embodiment.

FIG. 11A illustrates a first score generated based on a melody recorded first, and FIG. 11B illustrates a second score generated based on a melody recorded discontinuously later. A process of determining a similarity between a melody of the first score and a melody of the second score will be described in detail.

In the first score of FIG. 11A, 1) a vocal range of the melody is from A3 to G4, 2) a proportion of stable notes is similar to that of unstable notes, 3) A includes only an approaching progression, and A' mainly includes an approaching progression starting from a leaping progression, 4) an end portion of a melody shape goes up, 5) a rhythm complexity is relatively high since a start portion of a motive includes sixteenth notes and an end portion of the motive includes quarter or greater notes, and 6) the whole melody structure has a contrast in a unit of four measures (A+A'/A+A').

On the contrary, in the second score of FIG. 11B, 1) a vocal range of the melody is from G4 to E5, 2) a majority of the sounds of the melody are stable notes, 3) a start point of the melody includes a leap, 4) a melody shape goes down, 5) a rhythm of the melody is relatively long (quarter notes) at a beginning portion of a motive C, and is relatively long at an end portion of a motive D, and 6) the melody has a contrast in a unit of two measures (C/D), which are similar to each other.

Further, 7) when comparing chord information of the melody, the first score is music mainly including a 7th chord and chords with tension, and a number of measures include at least two chords each. On the contrary, the second score mainly includes triad chords, and a single chord is included in each measure.

As described above, when comparing the melodies recorded discontinuously based on 1) vocal range measurement, 2) determination of proportions of stable notes and unstable notes of melody constituent sounds, 3) melody progression, for example, measurement of leaping and approaching method, 4) melody shape measurement, 5) melody breath, rhythm measurement (quarter, eighth, or sixteenth note), 6) motive and variation measurement (melody pattern), and 7) melody chord information of the melodies, the melodies may be different in many aspects of attribute and pattern, and thus the melodies may be determined to be dissimilar.

As described above, to connect the dissimilar melodies, the bridge generator 342 of the melody connection processor 340 may generate a melody bridge for natural connection between the first melody and the second melody, and insert the melody bridge between the melodies.

Figure 12:
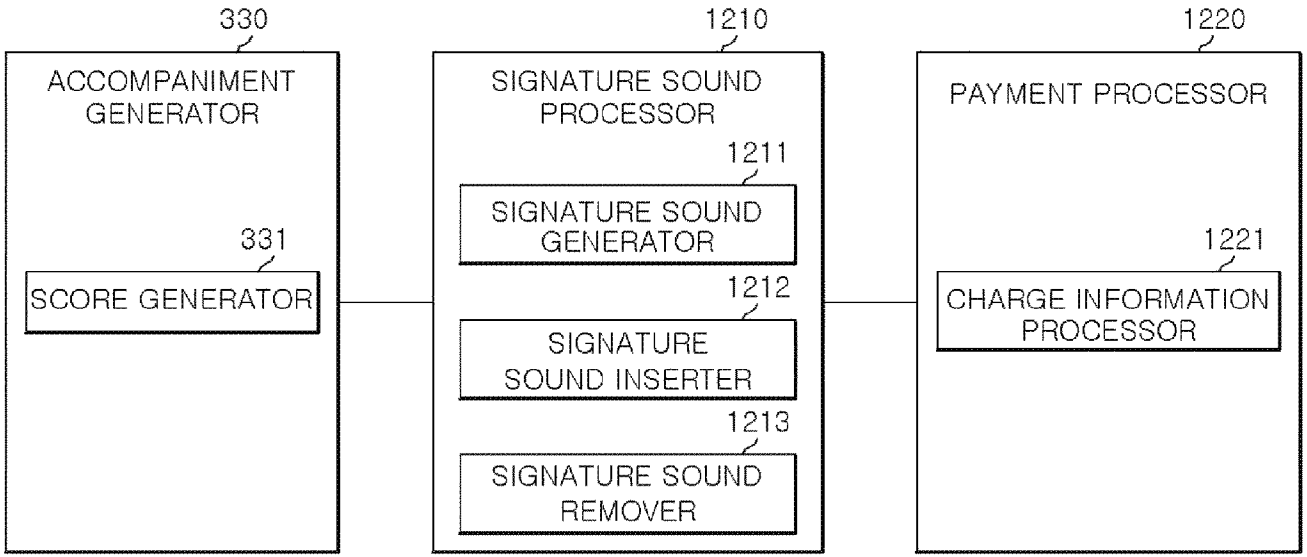
FIG. 12 is a block diagram illustrating a configuration of an apparatus for providing an accompaniment based on a humming melody of a user for signature sound processing according to an example embodiment.

FIG. 12 is a block diagram illustrating a configuration of an apparatus for providing an accompaniment based on a humming melody of a user for signature sound processing according to an example embodiment.

Referring to FIG. 12, a signature sound processor 1210 may include a signature sound generator 1211 configured to generate a signature sound, a signature sound inserter 1212 configured to insert the signature sound into a music source, and a signature sound remover 1213 configured to remove the inserted signature sound.

Here, the signature sound may be inserted at a predetermined position of the music source to spoil the original music. In this example, the user may need to remove the inserted signature sound to listen to the normal music, and thus may be induced to pay for the removal.

The signature sound generator 1211 may generate a signature sound to be inserted into the music source. In this example, the signature sound may include a sound corresponding to a symbol or a name of a songwriter or owner of the music or a company that provides an accompaniment based on a humming melody input as described herein.

The signature sound inserter 1212 may be configured to insert the generated signature sound at an appropriate position of the music source. In an example, the signature sound may be inserted at a position ahead of a start of the music, at a start portion of a verse, or an end portion of a verse to not greatly spoil the existing music, or may be inserted repeatedly at predetermined intervals.

In another example, in a case of generating a suitable accompaniment based on a humming melody of a user, the signature sound may be used to intentionally change a naturally generated sound to an inappropriate sound in view of a chord and a key of the music based on an analysis of the extracted melody.

Further, a naturally generated sound may be provided at an early stage of a free service period. When a predetermined period elapses, the signature sound may be inserted to induce the user to pay.

The signature sound remover 1213 may remove the inserted signature sound in response to a user payment or a predetermined free event.

The signature sound processor 1210 may be connected to a payment processor 1220 to determine whether to process the signature sound based on user payment information and charge information. The payment processor 1220 may include a charge information processor 1221. The charge information processor 1221 may include current and past charge history information of the user, and may determine whether to process the signature sound based on the charge history information.

Further, the signature sound processor 1210 may be connected to the accompaniment generator 330 to generate an accompaniment by inserting the signature sound in a case of generating the accompaniment based on the humming melody of the user. In addition, the score generator 331 may generate a score based on an accompaniment including a predetermined sound intentionally changed to an inappropriate sound, and the generated unnatural score may be provided to the user.

In the above configuration, an apparatus and method for providing an accompaniment based on a humming melody that may induce a user to pay by inserting a signature sound into a music source based on an accompaniment score generated based on the humming melody of the user.

Figure 13:
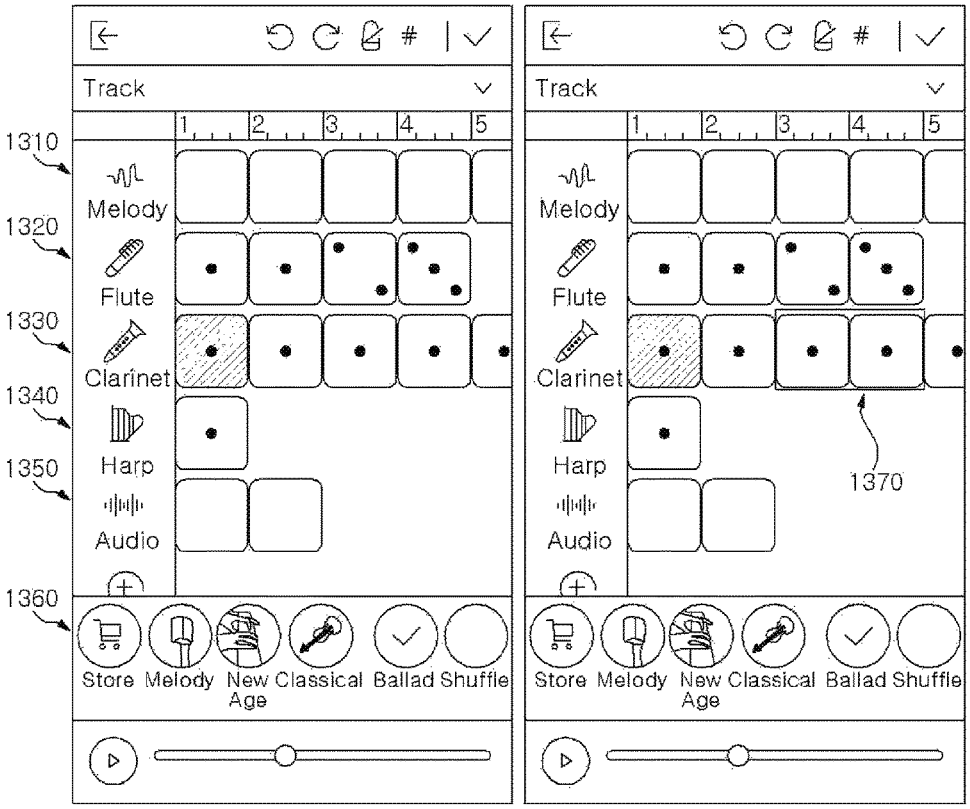
FIG. 13 illustrates an example of an accompaniment information providing screen using a dice dot pattern according to an example embodiment.

FIG. 13 illustrates an example of an accompaniment information providing screen using a dice dot pattern according to an example embodiment.

Referring to FIG. 13, score and accompaniment information provided on a user screen may be displayed to be distinct using square dice patterns formed for respective measures arranged horizontally on an upper end of the screen, and a dice dot pattern may be indicated in each square.

With respect to each track of the generated accompaniment and score, a plurality of musical instruments constituting the accompaniment may be displayed on individual layers. For example, accompaniment information related to each of a flute, a clarinet, and a harp constituting the corresponding accompaniment may be displayed in each instrument pattern indicator 1320, 1330, 1340. In a case in which the corresponding instrument is not played for the corresponding measure, a dice dot pattern may not be displayed in the corresponding measure. Here, the dice dot pattern may be displayed to distinguish an accompaniment pattern. In this example, having the same dice dot patter may be recognized as having the same accompaniment pattern or similar accompaniment patterns. Further, the dice dot pattern may indicate a complexity of the accompaniment. In this example, a greater number of dots may be recognized as a higher complexity of the accompaniment. In the example of FIG. 13, the pattern or complexity of the accompaniment may be expressed using the number of dots. However, the pattern or complexity of the accompaniment may also be expressed by changing shapes or colors of the dice dot patterns, or sizes of the dots.

Further, the dice dot pattern formed in the square as shown in FIG. 13 may be displayed in a 2×2 form including "1" to "4" dots, in a 3×3 form including "1" to "9" dots, or in a 4×4 form including "1" to "16" dots. The number of dice dot patterns may be appropriately selected based on a number of accompaniment patterns or complexities.

In FIG. 13, a melody region 1310 displayed above the three instrument pattern indicators 1320, 1330, and 1340 may display a score of the corresponding measure in response to a user selection, for example, a touch input or click input with respect to a square of the corresponding measure. Further, an audio region 1350 may express a volume value of a sound signal using a color or a dice dot pattern. After the accompaniment is generated based on the melody recording, a measure including music additionally recorded or additionally input based on the generated accompaniment may be displayed. In a case in which an accompaniment pattern is not provided in the audio region 1350, only a corresponding measure may be displayed and a dice dot pattern may not be displayed in the corresponding measure.

As shown in FIG. 13, accompaniment information related to each musical instrument may be displayed in a square form for each measure. Thus, the user may easily select a desired measure of the corresponding musical instrument. For example, as shown in a right image of FIG. 13, the user may select third and fourth measures 1370 of the clarinet through a drag motion, and change setting of the selected measures as desired. After selecting a measure, the user may sequentially change dice dots through a lateral scroll function, and change a volume value of the corresponding measure through a vertical scroll function. The user may change the musical instrument to another instrument of the same category through a tap function. For example, the user may change a type of a guitar from a classical guitar to an electric guitar.

Further, a genre selection region 1360 configured to select a music genre may be displayed at a lower end of the screen provided to the user. The music genre may be changed to a desired genre based on a user selection, and an accompaniment and an instrument information pattern corresponding to the selected genre may be provided.

As described above, a method of providing and correcting accompaniment information more intuitively and conveniently by providing an accompaniment pattern including a plurality of musical instruments using dice dot patterns, when providing a user with score and accompaniment information, may be provided.

Although the method and apparatus for providing an accompaniment based on a humming melody have been described in detail above through a number of example embodiments, the present disclosure is not limited thereto and should be construed as having the widest range according to the basic spirit disclosed herein. Those skilled in the art may implement a pattern of a form not stated above by combing or replacing the disclosed example embodiments, which should also be construed as within the scope of the present disclosure. Further, it will be apparent to those skilled in the art that various modifications and variation can be easily made to these example embodiments without departing from the spirit or scope of the claims.

What is claimed is:

1. A method of providing a melody recording based on a user humming melody in a user device, the method comprising:

displaying, on a screen of the user device, a record button;

recording a humming melody of a user in response to an actuation of the record button;

measuring a pitch of a sound related to the humming melody of the user that changes over time; and displaying, on the screen of the user device, a change in the pitch in real time, wherein a region in which the change in the pitch is displayed includes at least a portion of a left region of the screen of the user device, and wherein the displaying of the change in the pitch displays a change in the pitch measured within a predetermined period from a current point in time only on a left side of a reference line that is provided in a vertical direction at a center of the screen of the user device.

2. The method of claim 1, wherein a pitch value at the current point in time is displayed through a point that moves up and down in real time within the reference line based on the pitch value.

3. The method of claim 1, further comprising:

displaying a grid region including a grid on an upper portion of the screen of the user device to indicate a measure, wherein the grid is configured to move toward one side of the screen over time, and the grid region does not overlap the region in which the change in the pitch is displayed.

4. The method of claim 1, wherein information related to a size of a pitch value at a current point in time is displayed using at least one of a grid indication and a character.

5. The method of claim 1, wherein the recording is continued or paused based on whether the user maintains the input with respect to the record button.

6. The method of claim 1, further comprising:

displaying a waveform size of the sound in real time.

7. The method of claim 1, further comprising:

displaying a pitch tuning screen before the recording of the humming melody of the user is started, wherein the displaying of the pitch tuning screen displays information related to a size of a pitch value measured based on a current humming input of the user using at least one of a grid indication and a character.

8. The method of claim 7, wherein the displaying of the pitch tuning screen displays a button to set a noise-related input level, wherein, through an input of the user with respect to the button to set the noise-related input level, a threshold value related to a volume of an input signal set based on a measurement of current external noise is displayed, and settings related to the volume of the input signal of the user are changeable based on the threshold value.

9. The method of claim 1, further comprising:

displaying a score in which a note is generated for one or more measures of the score within a predetermined time range based on a humming input of the user.

10. The method of claim 9, wherein the note displayed on the score is determined based on a predetermined time and a predetermined tempo (beat per minute (BPM)) value.

11. The method of claim 9, wherein a sound recognized to have a change in a pitch value is displayed by being converted to a note in a measure of the score after a predetermined period elapses.

12. The method of claim 1, wherein the humming melody of the user is performed through a first recording in a first section and a second recording in a second section which is discontinuous to the first section, wherein the method further comprises determining whether a melody at a last portion of the first recording is similar to a melody at a front portion of the second recording.

13. The method of claim 12, wherein the determining is performed based on at least one of a vocal range, a chord, a rhythm, and melody pattern information.

14. The method of claim 12, further comprising:

connecting the melody at the last portion of the first recording to the melody at the front portion of the second recording by correcting at least one of the melody at the last portion of the first recording and the melody at the front portion of the second recording in response to determination that the melody at the last portion of the first recording is similar to the melody at the front portion of the second recording.

15. The method of claim 12, further comprising:

adding a bridge including at least one measure between the melody at the last portion of the first recording and the melody at the front portion of the second recording, in response to determination that the melody at the last portion of the first recording is not similar to the melody at the front portion of the second recording.

16. An apparatus for providing a melody recording based on a user humming melody, the apparatus comprising:

a user input receiver configured to receive a humming melody of a user for recording;

a pitch measurer configured to measure a pitch from the received humming melody in real time;

a record screen processor configured to generate, on a record screen, a record button to be used to start recording of the humming melody in response to an input of the user and a pitch displaying region to display a change in the pitch measured by the pitch measurer in real time; and a display configured to display the record screen, wherein the pitch displaying region includes at least a portion of a left region of the record screen and wherein the record screen displays a change in the pitch measured within a predetermined period from a current point in time only on a left side of a reference line that is provided in a vertical direction at a center of the record screen.

17. The apparatus of claim 16, wherein a pitch value at the current point in time is displayed through a point that moves up and down in real time within the reference line based on the pitch value.

18. The apparatus of claim 16, wherein the record screen processor is further configured to generate a grid region including a grid on an upper portion of the record screen to indicate a measure, wherein the grid is configured to move toward one side of the screen over time, and the grid region does not overlap the pitch displaying region.

* * * * *